United States Patent [19]

Schmit

[11] 3,976,283

[45] Aug. 24, 1976

[54] FLAG HOIST

[75] Inventor: Theodore F. Schmit, Arlington Heights, Ill.

[73] Assignee: Electronic Flag Poles, Inc., Maywood, Ill.

[22] Filed: Feb. 24, 1975

[21] Appl. No.: 552,428

[52] U.S. Cl. ..... 254/146; 116/173; 187/9 R; 74/528

[51] Int. Cl.[2] ..... B66C 23/60

[58] Field of Search ..... 254/175.3, 163, 164, 254/146, 186 HC, 138.1, 139; 116/173; 187/9, 10; 74/545, 528, 548, 577 R; 52/146; 318/452

[56] References Cited

UNITED STATES PATENTS

| | | | |
|---|---|---|---|
| 1,668,500 | 5/1928 | Gillespie | 187/10 |
| 2,465,796 | 3/1949 | Freeman | 187/9 R |
| 3,031,168 | 4/1962 | Rambaldi | 254/164 |
| 3,418,967 | 12/1968 | Donkersloot | 116/173 |
| 3,675,615 | 7/1972 | Stangarent et al. | 116/173 |
| 3,896,904 | 7/1975 | Walker | 187/9 R |

*Primary Examiner*—Robert J. Spar
*Assistant Examiner*—Kenneth Noland
*Attorney, Agent, or Firm*—McCaleb, Lucas & Brugman

[57] ABSTRACT

A flagpole assembly having a manually actuated hoist for raising and lowering a flag mounted on an endless halyard which is trained about a driving sheave wheel driven by a manually actuated drive shaft and gear train assembly powered by a portable hand crank, detachably associated with the drive shaft. Pawl means are provided for preventing operation of the drive means and movement of the halyard when the hand crank is removed from the drive shaft while conversely releasing the drive means for operation in response to the interconnection of the hand crank with the drive shaft.

3 Claims, 6 Drawing Figures

Fig. 1.
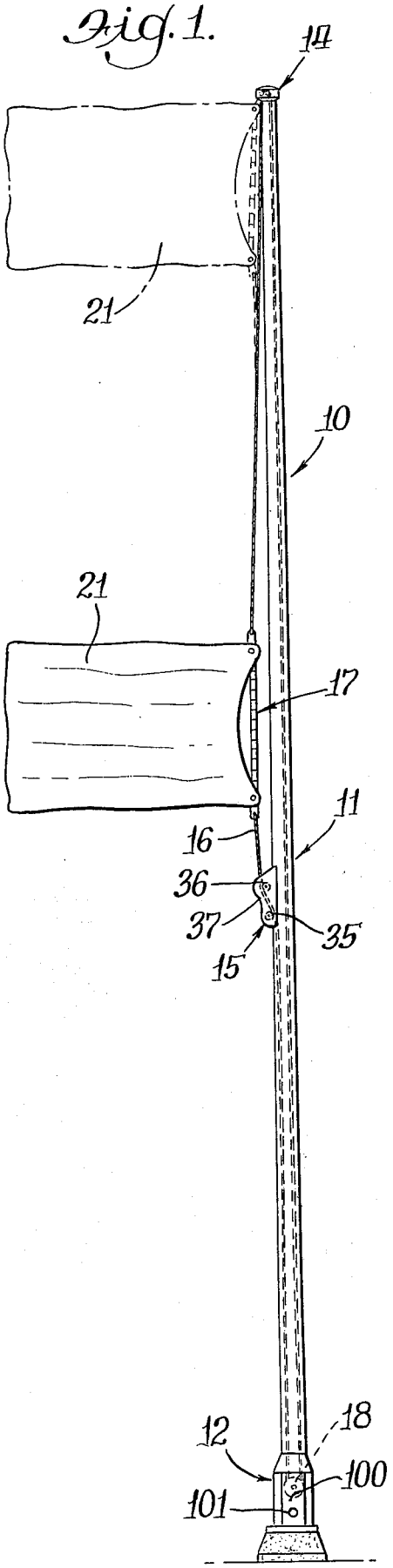
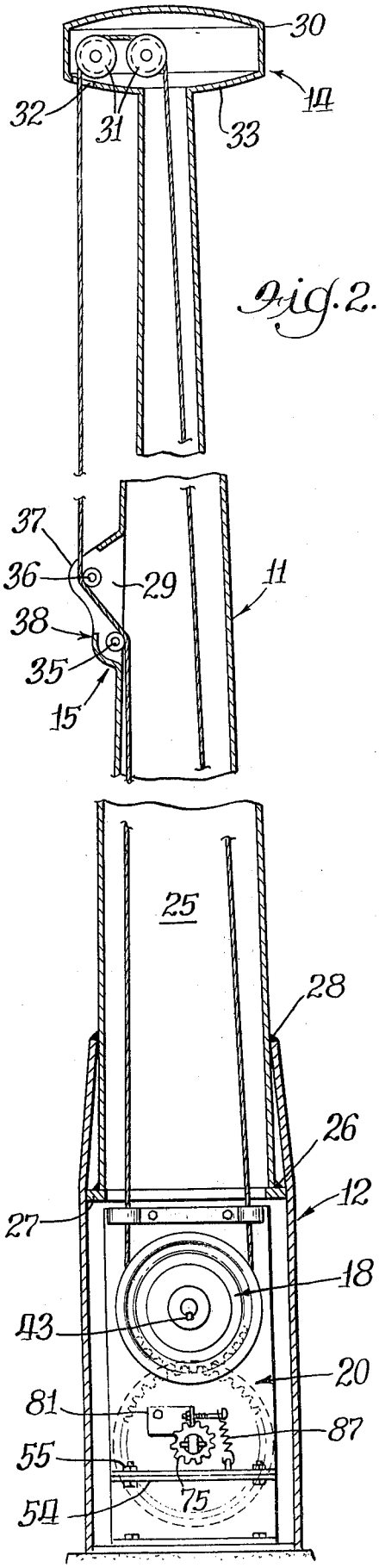
Fig. 2.

Fig. 3.
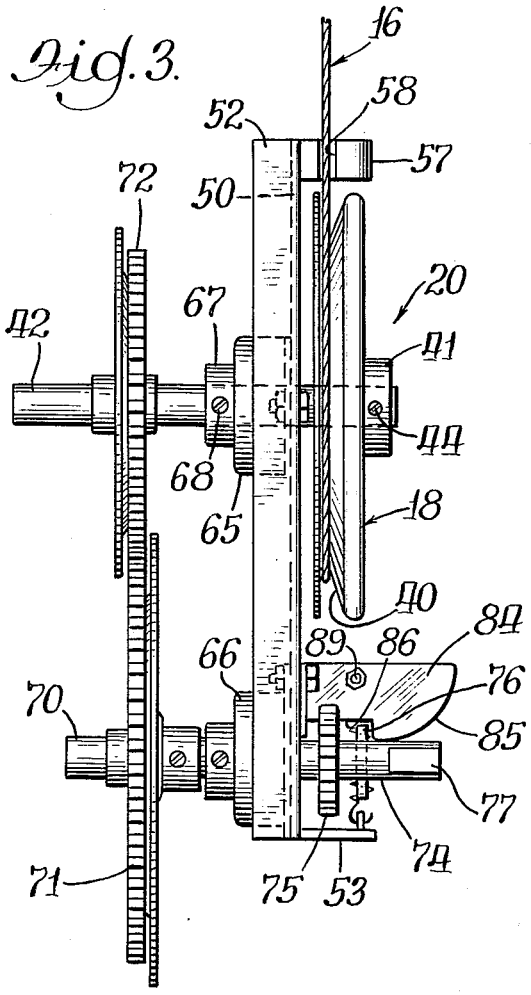
Fig. 4.
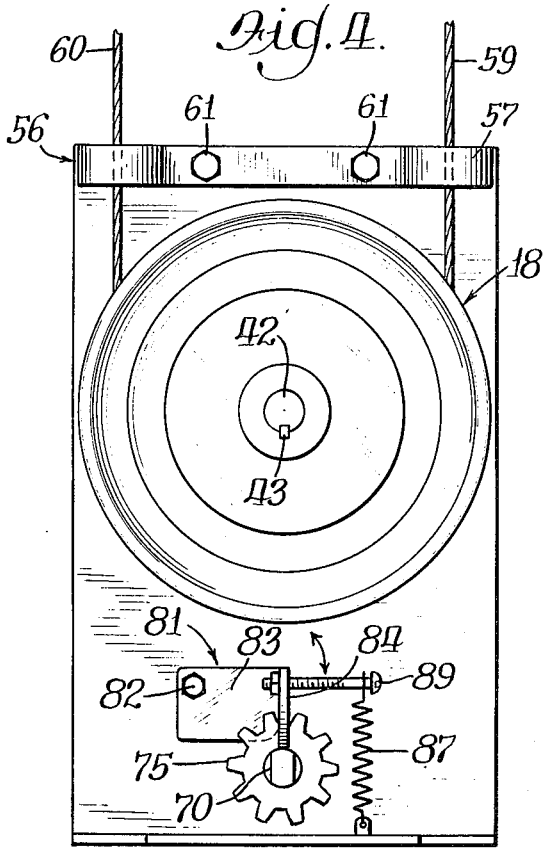
Fig. 5.
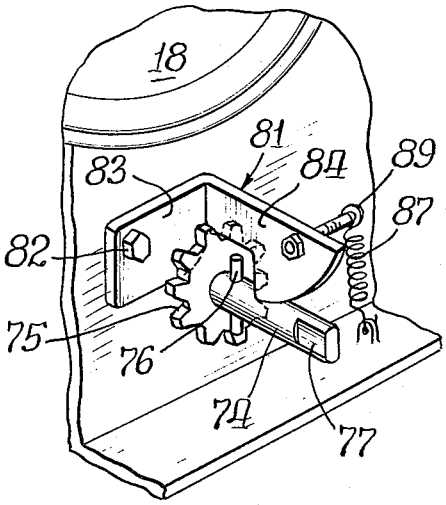
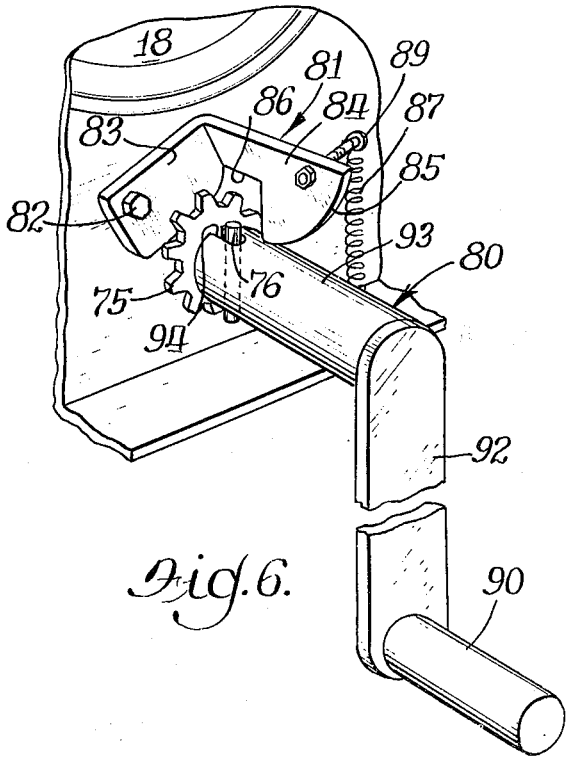
Fig. 6.

FLAG HOIST

BACKGROUND OF THE INVENTION

This invention relates generally to flagpoles, and more particularly to improved manually operable hoist means for actuating a flag carrying halyard.

The present invention has particular utility in flag hoist systems employing an endless halyard for raising and lowering a flag in response to actuation of reversible drive systems.

In U.S. Pat. No. 3,418,967, issued Dec. 31, 1968, as well as my prior U.S. Pat. No. 3,737,749, issued June 5, 1973, automatic flagpoles employing endless halyards and electrically motorized, automatically reversible drive means are disclosed. While such automatic flagpoles have been highly successful and fully satisfactory in operation, they nevertheless embody relatively expensive control systems requiring an electrical power supply for the motorized drive means and controls. In certain remote areas the needed electrical power is not always conveniently available and in other instances the initial installation and costs of a power actuated automatic flagpole may be economically burdensome to the prospective user. As a consequence, need has arisen for a simplified manually operable hoist system for flagpoles of the general type disclosed in the above noted patents which employ endless halyard means and are featured by the capability of protectively storing a lowered flag within the interior of the flagpole.

SUMMARY OF THE INVENTION

In brief, the present invention is directed to a new and improved manually operable hoist means having particular utility with flagpole assemblies employing an endless halyard capable of being reversibly operated to raise and lower a flag, and preferably of the type in which the flag is automatically stored within a protective interior chamber of the flagpole. To that end the present invention includes an endless halyard trained over a rotatably driven sheave wheel and a remote truck assembly at the peak of the flagpole. A manually operable drive means is provided for rotatably actuating the sheave wheel whereby to effect the raising and lowering movements of the halyard to correspondingly raise and lower the flag attached thereto. To that end the drive means of this invention includes a driving gear train associated with the sheave wheel, a drive shaft for actuating the gear train, a manually operable hand crank detachably associated with the drive shaft, and pawl means for automatically locking the drive means to prevent movement of the halyard when the hand crank is removed from the drive shaft while permitting the selective operation thereof when the hand crank is coupled to the drive shaft.

It is an important object of this invention to provide a new and improved manually operated apparatus for raising and lowering a flag.

Another important object of this invention is to provide an improved manually operated drive means for use with an endless halyard including means for automatically locking the halyard against movement except when manual action of the drive means is desired.

Still another important object of this invention is to provide an improved manually operated drive means for a flag halyard employing a simplified arrangement of parts and means for automatically arresting the halyard at desired positions.

Having thus described the present invention, the above and further objects, features and advantages thereof will become apparent from the following detailed description of a preferred embodiment thereof illustrated in the accompanying drawings and representing the best mode presently contemplated to enable those skilled in the art to understand and practice this invention.

In the drawings:

FIG. 1 is a side elevational view of a flagpole assembly embodying the hoist means of this invention;

FIG. 2 is an enlarged foreshortened view of the flagpole assembly of FIG. 1 in vertical cross section, with parts thereof shown in full elevation;

FIG. 3 is an enlarged view in side elevation of the drive means shown in FIG. 1;

FIG. 4 is a front elevation of the drive means shown in FIG. 3;

FIG. 5 is a partial perspective view of the pawl means employed in the drive means of FIGS. 3 and 4 illustrating the same in a locked condition; and FIG. 6 is another partial perspective view, similar to FIG. 5, showing releasing actuation of the pawl means in response to mounting of the hand crank on the drive shaft.

DESCRIPTION OF THE PREFERRED EMBODIMENT

Turning now to the embodiment of the present invention illustrated in the accompanying drawings, reference is initially made to FIGS. 1 and 2 showing an upright flagpole assembly 10 comprising tubular metal pole means 11 undersupported by a ground engaging base 12. A truck assembly 14 is mounted over the upper or peak end of the flagpole and a flag furling and guiding means 15 is provided substantially midway of the pole means to provide entry to its hollow interior. An endless flag carrying halyard means 16 having an articulated anti-fouling assembly 17 is trained over and extends between the truck assembly 14 and a driving sheave wheel 18 associated with drive means 20 mounted within the base 12. The anti-fouling means 17 mounts a flag 21 for movement with and by the halyard means, and passes with the halyard through the guiding means 15 in operation.

The pole means 11, as best illustrated in FIG. 2, is suitably formed as an elongated tubular assembly reducing in cross section from its base to the upper end thereof and for convenience may be formulated of one or more matching sections welded together in final assembly. The lower portions of the pole means, principally that portion between the flag furling and guiding means 15 and its base end, is of a general diameter sufficient to accommodate the storage of a flag within a hollow interior storage chamber 25, as designated in FIG. 2. The base end 26 of the pole means is suitably welded and undersupported on a horizontally disposed annular plate 27 of the base assembly 12.

As shown in FIG. 2, the base assembly 12 is welded to the lower end 26 of the pole means as at plate 27 and the upper end of a frusto-conical wall portion 28 thereof. Importantly, the pole means 11 is provided with a lateral opening 29 substantially at its mid point over which the flag furling and guiding means 15 is mounted and through which the halyard and flag pass to and from the storage chamber 25.

At the extreme outer or peak end of the pole means 11 is the truck assembly 14 comprising generally cylindrical overcovered housing 30 suitably configured to provide a decorative cap to the pole and mounting within its interior a pair of laterally spaced rollers 31, 31. Rollers 31 preferably have a V-shaped periphery to provide a trackway for guiding the halyard 16 which passes through an opening 32 in the lower wall 33 of truck assembly housing, over the rollers 31 and thence downwardly to engage and train about the periphery of the sheave wheel 18. From the sheave wheel the halyard leads upwardly to and through opening 29 and the flag furling and guiding means 15 passing outwardly of the flagpole to the truck assembly 14.

The flag furling and guiding means, as shown in FIG. 2, comprises a pair of vertically spaced and laterally offset guide rollers 35 and 36 extending horizontally between laterally spaced side walls 37, of a housing 38 which is generally open along one side thereof to permit passage of the halyard 16 and flag.

As previously noted, the halyard means 16 preferably is formed of woven wire cable and is endless to provide a continuous circular loop carrying the anti-fouling means 17 which may be of the order described more fully in the aforenoted U.S. Pat. No. 3,418,967. Generally speaking means 17 includes a plurality of cylindrical spools or the like which surround the halyard to prevent the flag from fouling the halyard.

As noted heretofore, the continuous or endless halyard is trained about the periphery of the sheave wheel means 18, which as best shown in FIGS. 3 and 4 of the drawings comprises a disc type wheel having a V-shaped peripheral groove 40 for drivingly engaging the cable halyard 16. Sheave wheel 18 further includes a central cylindrical hub portion 41 adapted to be fastened to a horizontal idler shaft 42, as by key and keyway means 43 and set screw means 44 (see FIG. 2).

Sheave wheel means 18, of course, provides the means for transmitting the driving force of drive means 20 to the cable halyard whereby the latter is reversibly moved to raise and lower a flag 21 in accordance with the actuation of the sheave wheel.

The drive means 20 provides the operational actuation of the sheave wheel 18 and comprises a vertical supporting base plate 50 having parallel flanged side wall portions 52 extending in like directions from the plane of the base plate and a horizontally disposed bottom mounting flange portion 53. Mounting portion 53 is operationally mounted over a mating support flange portion 54 at the base assembly 20 (see FIG. 2) and is fastened thereto as by connector bolt means 55. At the upper end of the base plate 50 and traversing its longitudinal axis is a cable guide means 56 having a pair of open guide ears 57, each suitably slotted at 58 (see FIG. 3) to accommodate the right and left hand reaches 59 and 60 of the halyard as viewed in FIG. 4. Bolt means 61 serve to rigidly fasten the guide means to the upper end of the base plate 50 so as to project outwardly from the latter immediately over the sheave wheel means 18.

Mounted centrally between the flange wall portions 52 of the base plate and in vertical spaced relation are a pair of thrust collar bearing assemblies 65, 66, the uppermost one of which receives and rotatably supports the idler shaft 42 on which the sheave wheel 18 is mounted. It will be noted that the collar portion 67 of the bearing assembly 65 includes a set screw means 68 for axially positioning and locking the shaft 42 thereto. In similar fashion, the lowermost bearing assembly 66 supports a drive shaft 70; the two shafts 42 and 70 being aligned in vertical spaced relation.

Rearwardly of the two thrust collar bearing assemblies is a driving gear train comprising a large drive gear 71 fixed to drive shaft 70 and having its toothed periphery engaged with the teeth of a smaller driven gear 72 mounted on the idler shaft 42. With this arrangement the driven gear 72 and the associated sheave wheel means are rotatably driven at increased velocity over the drive gear means to provide a desired mechanical advantage to the operator. Typically gear 72 and shaft 42 may rotate substantially one and one-third revolutions for each revolution of drive shaft 70 and drive gear 71.

On the opposite side of base plate 50 from the drive gear means 71, an extending portion 74 of the drive shaft supports a non-rotatably attached pawl gear means 75 (see FIG. 3). Axially beyond gear 75, shaft portion 74 is traversed by a radially projecting drive pin 76 while the outer end of shaft portion 74 is formed with a pair of parallel spaced, planar driving surfaces 77. The pin 76 and surfaces 77 cooperate in providing driving engagement between the drive shaft and hand crank 80 (see FIG. 6) as will be described presently.

Mounted on the base plate 50 immediately adjacent the pawl gear 75 is a latch or pawl means 81 pivotally attached to the base plate 50 by a pivot connector 82. Pawl means 81 includes a main body portion 83 having a right angularly related actuator arm portion 84 at one end which is aligned with the central axis of the drive shaft 70. The outer end and lower edge of arm 84 are suitably formed to provide a curvilinear cam portion 85 and an inset locking shoulder 86 (see FIG. 6). A tension spring 87 extends between a mounting ear 88 extending upwardly from the base flange 53 on the base plate and bolt means 89 extending outwardly from arm 84, parallel to the body portion 83. With this arrangement, the spring means 86 serves to normally bias the pawl means 81 toward the shaft 70, locking shoulder portion 86 thereof in the multi-position detent spaces between the teeth of the pawl gear 75, as illustrated best in FIGS. 3 and 5 of the drawings.

It will be recognized that with the pawl means 81 actively engaged with the gear means 75, rotation of the drive shaft 70 is effectively prevented. Consequently, rotational actuation of the sheave wheel means 18 and the attendant movement of the halyard 16 is selectively arrested. By this feature the operator is able to selectively position the flag 21 at any desired elevation along the pole means, as at fully raised and half staff positions indicated in FIG. 1 of the drawings.

Turning now to the features of the operating crank means 80, particular reference is made to FIG. 6 of the drawing whereat the same is shown in its mounted condition over the end portion 74 of the drive shaft 70 to rotate the latter. As there shown, crank means 80 comprises a manually engageable handle portion 90, rotatably mounted on spindle (not shown) affixed to the outer end of a crank arm 92. A driving body 93 thereof is fixed to the other end of crank arm 92 and is bifurcated at its inner end by slotted opening 94 for engaging and embracing the projecting ends of drive pin 76 when the crank means is mounted over the drive shaft. In this latter respect it will be understood that the body 93 has a cylindrical socket formed inwardly of its bifurcated end which has a suitable interior configuration to actively engage the surface portions 77 on the drive shaft.

Uniquely, as amply illustrated in FIG. 6, mounting of the crank means 80 over the outer end of the drive shaft automatically biases the pawl means 81 upwardly against the downwardly biasing forces of spring means 87 to disengage the portion 86 thereof from the teeth of the pawl gear. Thus the drive shaft is automatically freed for active rotation by crank operation in either direction in accordance with the desires of the operator for raising and lowering the flag. Conversely, removal of the crank means 80 from the drive shaft automatically releases the pawl means 81 to the normal biasing effects of spring means 87, thereby forcing portion 86 thereof to engage the teeth of the pawl gear 75. In the event that portion 86 rides on the outer end of a gear tooth on withdrawl of the crank means 80, slight movement of the halyard will effectively actuate the drive means sufficiently to cause the pawl means to drop into a detent space between the teeth of the pawl gear and thus lock the drive means and halyard against further movement.

As noted best from FIG. 1 of the drawings, the base 12 for the flagpole includes a cover door 100 having an opening 101 opposite the drive shaft for insertion of the crank means 80. Preferably the cover door is locked in place as by special beaded screws or lock means to render the drive means substantially tamper-proof. Inasmuch as the operating crank means is detachable and must be removed in order to lock the halyard, security of the hoist mechanism is conveniently maintained by restricting custody of the hand crank to authorized personnel.

From the foregoing description, it is believed that those familiar with the art will readily recognize and appreciate the novel advancement presented by the herewith described invention and realize that while the same has been described in association with the preferred embodiment of its features as set forth and illustrated in the accompanying drawings, the same is susceptible to obvious modifications and substitutions of equivalent means within the skill of the art.

The embodiments of the invention in which an exclusive property or privilege is claimed are defined as follows:

1. In a flagpole assembly employing an endless flag supporting halyard, manually operable hoist means for actuating the halyard comprising: a bi-directionally rotatable sheave wheel having peripheral engagement with the halyard whereby to move the latter responsively with rotation of said sheave wheel, a drive shaft rotatably supported adjacent said sheave wheel, means intercoupling said drive shaft and sheave wheel for actuating the latter in response to driving rotation of said drive shaft, portable hand crank means having a body formed with an open ended socket coaxially receptive of one end of said drive shaft whereby said crank means is detachably mounted on said drive shaft, cooperating means on said body and drive shaft for positively interconnecting said crank means and drive shaft for conjoint bi-directional rotation, multi-position detent means mounted on and movable with said shaft, pawl means adjacent to and normally engaged with said detent means whereby to lock said shaft and sheave wheel against rotation, and cam means provided on said pawl means and operatively engaged by said body in the course of interconnecting said crank means with said shaft whereby to automatically disengage said pawl means from said detent means and free said shaft and sheave wheel for bi-directional rotation in accordance with rotational operation of said crank means.

2. The combination of claim 1 wherein said means intercoupling said drive shaft and sheave wheel comprises an idler shaft supporting said sheave wheel, and a gear train drivingly interconnecting said drive shaft and idler shaft.

3. The combination of claim 1 wherein said multiposition detent means comprises a toothed gear affixed to said drive shaft, and said pawl means comprises a pivotally supported latch having an arm engageable with the teeth of said gear, and spring means normally biasing said arm into interlocking engagement with said teeth.

* * * * *